US005287605A

United States Patent [19]

Badertscher et al.

[11] Patent Number: 5,287,605

[45] Date of Patent: Feb. 22, 1994

[54] DEVICE FOR MANIPULATING HEALDS OR DROP WIRES IN A WARP-THREAD DRAWING-IN MACHINE

[75] Inventors: Markus Badertscher, Seewis; Hermann Eglseer, Uster, both of Switzerland

[73] Assignee: Zellweger Uster AG, Uster, Switzerland

[21] Appl. No.: 856,031

[22] PCT Filed: Sep. 3, 1991

[86] PCT No.: PCT/CH91/00190

§ 371 Date: May 11, 1992

§ 102(e) Date: May 11, 1992

[87] PCT Pub. No.: WO92/05303

PCT Pub. Date: Apr. 2, 1992

[30] Foreign Application Priority Data

Sep. 17, 1990 [CH] Switzerland ..... 0300090

[51] Int. Cl.[5] ..... D03J 1/14

[52] U.S. Cl. ..... 28/207

[58] Field of Search ..... 28/205, 206, 207, 204, 28/203.1, 201, 202, 208, 212; 139/349, 354

[56] References Cited

U.S. PATENT DOCUMENTS

| | | | |
|---|---|---|---|
| 2,445,999 | 7/1948 | Drake | 28/207 X |
| 3,681,825 | 8/1972 | Meierhofer | 28/206 |
| 4,499,638 | 2/1985 | John et al. | 28/207 |
| 4,815,498 | 3/1989 | Gryson et al. | 28/207 |
| 4,891,871 | 1/1990 | Tachibana et al. | 28/205 |
| 5,088,523 | 2/1992 | Bucher et al. | 28/205 X |
| 5,136,762 | 8/1992 | Gironi | 28/205 X |
| 5,148,585 | 9/1992 | Jaeger | 28/205 |
| 5,153,972 | 10/1992 | Fabrizio | 28/205 X |

FOREIGN PATENT DOCUMENTS

| | | | |
|---|---|---|---|
| 1290385 | 9/1972 | United Kingdom | 20/205 |
| 2109426 | 2/1983 | United Kingdom | 28/207 |

*Primary Examiner*—Clifford D. Crowder
*Assistant Examiner*—Larry D. Worrell, Jr.
*Attorney, Agent, or Firm*—Burns, Doane, Swecker & Mathis

[57] ABSTRACT

The device serves to manipulate the healds or drop wires from their separation from a stack via the drawing-in of the warp threads up to the transfer to supporting members provided for arranging in a weaving machine and it contains holding devices for accepting the separated healds or drop wires and for positively transporting them to a drawing-in station and a transfer station, positioning elements arranged in the area of the drawing-in station, and transfer devices, arranged in the area of the transfer station, for transferring the healds or drop wires having a drawn-in warp thread to the supporting members.

Consequently, only a single type of manipulating arrangement is required for manipulating the healds and drop wires from their separation up to the transfer to the supporting members. That results in a substantial reduction in potential sources of error and thus in the susceptibility to trouble. In addition, only two interfaces are necessary: one leading to the separating station and one at the transfer station leading to the supporting members.

23 Claims, 7 Drawing Sheets

51
B
B
44
43
42
8
48
42
46
40
42
42
FE
47
44
48
53
12
60
61
12
60
61

DEVICE FOR MANIPULATING HEALDS OR DROP WIRES IN A WARP-THREAD DRAWING-IN MACHINE

FIELD OF THE INVENTION

The present invention relates to a device for manipulating healds or drop wires (designated below as harness members) in a warp-thread drawing-in machine from their separation from a stack via the drawing-in of the warp threads up to the transfer to supporting members provided for being arranged in a weaving machine.

BACKGROUND

Devices of this type known hitherto, as are used, for example, in the warp-thread drawing-in machine USTER DELTA of Zellweger Uster AG, comprise a multiplicity of various elements which in each case always perform only a limited partial function within the sequence. With regard to the manipulation of the drop wires, this means, for example, that these drop wires after their separation, are transported by first members to the drawing-in position, are gripped there by second members and turned for the orientation for the drawing-in of the warp threads and are then transported further by third members, the various members only being partly connected frictionally to the drop wires.

Apart from the fact that the plurality of various members makes the device more expensive, the interfaces in particular between the various members inside the device represent potential sources of error. This especially applies when there is a frictional connection between the members and the drop wires.

SUMMARY OF THE SUBJECT MATTER OF PRESENT INVENTION

An object of invention, then, is to provide a device of the type mentioned at the beginning in which the potential sources of error are minimised and the costs are kept as low as possible.

This object is achieved according to the invention by holding means for accepting the separated harness members and for positively transporting them to a drawing-in station and a transfer station, by positioning means arranged in the area of the drawing-in station, and by transfer means, arranged in the area of the transfer station, for transferring the harness members having a drawn-in warp thread to the supporting members.

The device, according to the invention therefore requires only a single type of manipulating means for manipulating the healds or drop wires from the point where they are separated from a stack up to the point where they are transferred to their supporting members. Due to the elimination of a multiplicity of potential sources of error and causes of trouble, the device is substantially less susceptible to trouble in operation. For integrating into the drawing-in process, the device requires merely two interfaces: one leading to the separating station and one at the transfer station leading to the supporting members. The susceptibility to trouble is also substantially reduced and in addition the possibility of a modular construction of the drawing-in machine presents itself.

BRIEF DESCRIPTION OF THE DRAWINGS

The invention is described in greater detail below with reference to an exemplary embodiment and the drawings, in which.

DETAILED DESCRIPTION OF PREFERRED EMBODIMENTS

Figure 1:
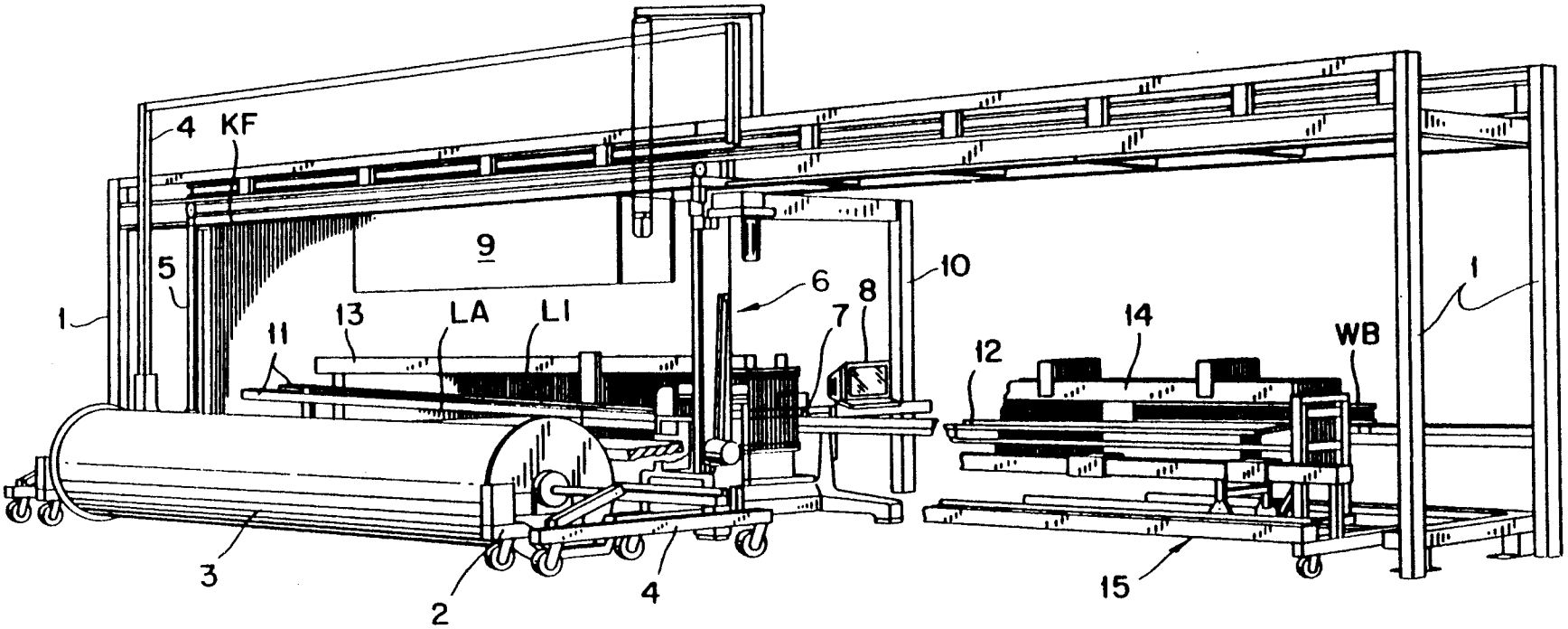
FIG. 1 shows a perspective overall representation of a drawing-in machine according to the invention.

According to FIG. 1, the drawing-in machine consists of a mounting stand 1 and various subassemblies arranged in this mounting stand 1, each of which subassemblies represents a functional module. A warp-beam truck 2 with a warp beam 3 arranged thereon can be recognized in front of the mounting stand 1. In addition, the warp-beam truck 2 contains a so-called lifting device 4 for holding a frame 5, on which the warp threads KF are clamped. This clamping is effected before the actual drawing-in and at a location separate from the drawing-in machine. The frame 5 is positioned at the bottom end of the lifting device 4 directly next to the warp beam 3. For the drawing-in, the warp-beam truck 2, together with warp beam 3 and lifting device 4, are moved to the so-called setting-up side of the drawing-in machine and the frame 5 is lifted upwards by the lifting device 4 to then assume the position shown.

The frame 5 and the warp beam 3 are displaced in the longitudinal direction of the mounting stand 1. During this displacement, the warp threads KF are directed past a thread-separating unit 6 and as a result are separated and selected. After the selection, the warp threads KF are cut off and presented to a drawing-in needle 7, which forms a component of the so-called drawing-in module. The selecting device used in the warp tying machine USTER TOPMATIC of Zellweger Uster AG can be used, for example, for the selection of the warp threads.

Next to the drawing-in needle 7 can be recognized a video display unit 8, which belongs to an operating station and serves to display machine functions and machine malfunctions and to input data. The operating station, which forms part of a so-called programming module, also contains an input stage for the manual input of certain functions, such as, for example, creep motion, start-stop, repetition of operations, and the like. The drawing-in machine is controlled by a control module which contains a control computer and is arranged in a control box 9. Apart from the control computer, this control box contains a module computer for every so-called main module, the individual module computers being controlled and monitored by the control computer. The main modules of the drawing-in machine, apart from the modules already mentioned—drawing-in module, yarn module, control module and programming module, are the heald, drop-wire, and reed modules.

The thread-separating unit 6, which presents the warp threads KF to be drawn in to the drawing-in needle 7, and the path of movement of the drawing-in needle 7, which runs vertically to the plane of the clamped warp threads KF, define a plane in the area of a support 10 forming part of the mounting stand 1, which plane separates the setting-up side already mentioned from the so-called taking-down side of the drawing-in machine. The warp threads and the individual elements into which the warp threads are to be drawn in are fed at the setting-up side, and the so-called harness (healds, drop wires and reed) together with the drawn-in warp threads can be removed at the taking-down side. During the drawing-in, the frame 5 having the warp threads KF and the warp-beam truck 2 having the warp beam 3 are moved to the right past the thread-separating unit 6, in the course of which the drawing-in needle 7 successively removes from the frame 5 the warp threads KF clamped on the latter.

When all warp threads KF are drawn in and the frame 5 is empty, the latter, together with the warp-beam truck 2, the warp beam 3 and the lifting device 4, is located on the taking-down side.

Arranged directly behind the plane of the warp threads KF are the warp-stop-motion drop wires LA, behind the latter the healds LI and further to the rear the reed. The drop wires LA are stacked in hand magazines and the full hand magazines are hung in sloping feed rails 11, on which they are transported to the right towards the drawing-in needle 7. At this location they are separated and moved into the drawing-in position. Once drawing-in is complete, the drop wires LA pass on drop-wire supporting rails 12 to the taking-down side.

The healds LI are lined up on rails 13 and shifted automatically on the latter to a separating stage. The healds LI are then moved individually into their drawing-in position and, once drawing-in is complete, are distributed over the corresponding heald shafts 14 on the taking-down side. The reed is likewise moved step-by-step past the drawing-in needle 7, the corresponding reed gap being opened for the drawing-in. After the drawing-in, the reed is likewise located on the taking-down side. A part of the reed WB can be recognized to the right next to the heald shafts 14. This representation is to be understood purely as an illustration, since the reed, at the position shown of the frame 5, is of course located on the setting-up side.

As further apparent from the figure, a so-called harness truck 15 is provided on the taking-down side. This harness truck 15, together with the drop-wire supporting rails 12, fixed thereon, heald shafts 14 and holder for the reed, is pushed into the mounting stand 1 into the position shown and, after the drawing-in, carries the harness having the drawn-in warp threads KF. At this moment, the warp-beam truck 2 together with the warp beam 3 is located directly in front of the harness truck 15. By means of the lifting device 4, the harness is now reloaded from the harness truck 15 onto the warp-beam truck 2, which then carries the warp beam 3 and the drawn-in harness and can be moved to the relevant weaving machine or into an intermediate store.

The functions described are distributed over a plurality of modules which represent virtually autonomous machines which are controlled by a common control computer. The cross connections between the individual modules run via this higher-level control computer and there are no direct cross connections between the individual modules. The main modules (already mentioned) of the drawing-in machine are themselves also of modular construction and as a rule consist of submodules. This modular construction is described in Swiss Patent Application No. 03 633/89-1, to the disclosure of which reference is herewith expressly made.

Figure 2:
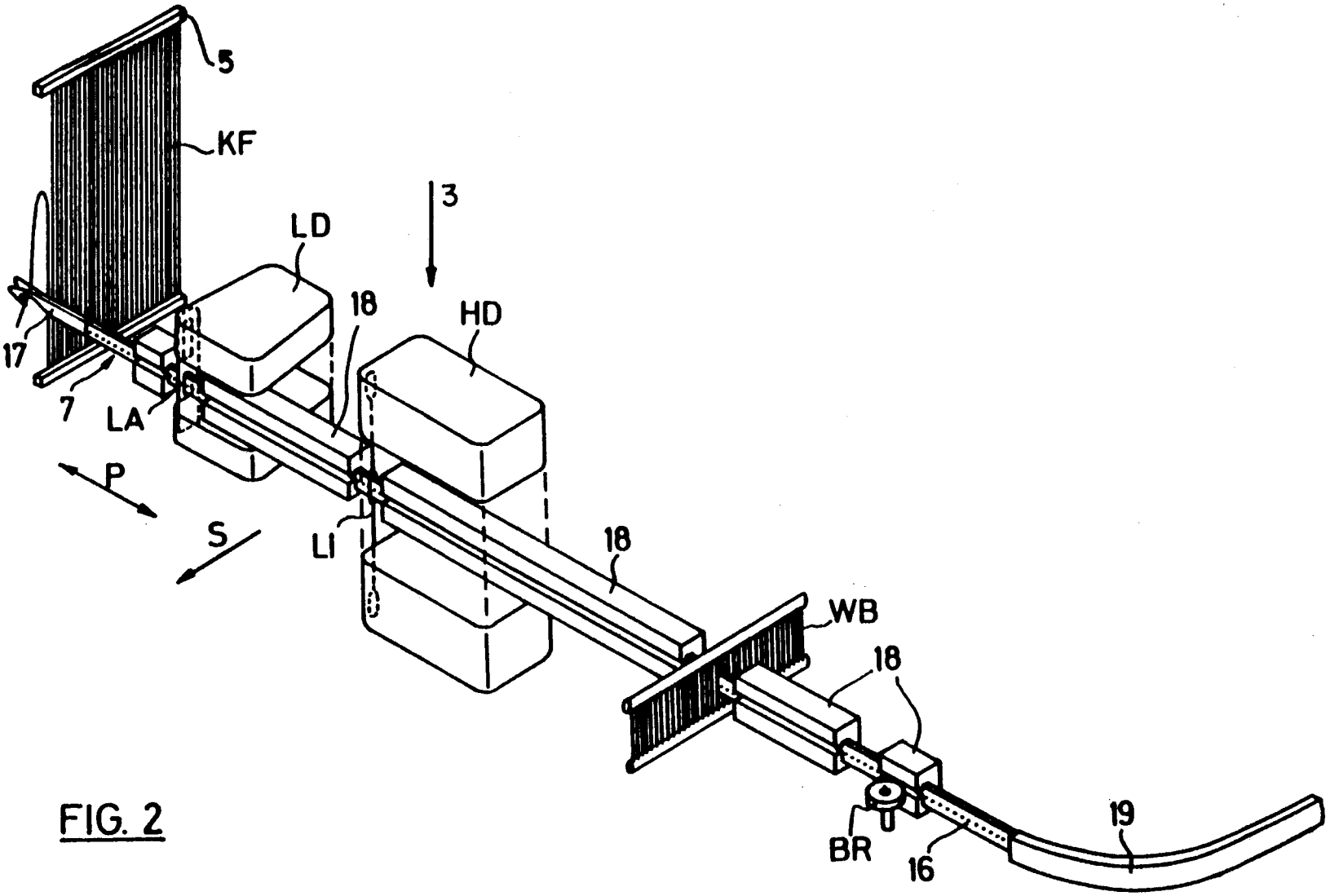
FIG. 2 shows a perspective representation of the drawing-in module of the drawing-in machine in FIG. 1.

As apparent from FIG. 2, the drawing-in needle 7, which forms the main component of the drawing-in module, is formed by a gripper band 16 and a clamping gripper 17 carried by the same. The drawing-in needle 7 is guided in the lifting direction (arrow P) in a channel-like guide 18 which extends from the frame 5 in a rectilinear direction up to a curved end part 19. The guide 18 passes through the drawing-in machine and is in each case interrupted in the area of the harness members (drop wires LA, healds LI) and the reed WB in order to permit the feed of the harness members to the drawing-in position and their further transport after drawing-in is complete up to the transfer (arrow S) to drop-wire supporting rails 12 and to the heald shafts 14 (FIG. 1) or the drawing-in of the warp threads into the reed WB, the so-called reeding. The gripper band 16 is provided with feed holes at a uniform distance apart and is driven by a band wheel BR which can be motor-driven and which has on its periphery lobe-shaped or stud-shaped projections which engaged the feed holes.

The feed of the drop wires LA and the healds LI to the drawing-in position and their further transport up to the transfer to the drop-wire supporting rails or to the heald shafts is effected by a submodule drop-wire distribution LD and by a submodule heald distribution HD. In the transport direction of the healds LI, the heald distribution module HD follows the submodule heald separation, which is described in Swiss Patent Application No. 706/90. In the transport direction of the drop wires LA, the drop-wire distribution module LD follows the submodule drop-wire separation, which is described in Swiss Patent Application 2699/90.

Both submodules HD and LD perform the same functions in principle by accepting healds or drop wires presented to them sequentially, by transporting them to their drawing-in position and by transporting them further after drawing-in of the warp threads is complete to a transfer station, where transfer to the heald shafts or drop-wire supporting rails is effected.

As can be gathered from the abovementioned Swiss Patent Application No. 706/90, the frontmost heald LI, lying directly in front of the submodule HD, of a heald stack is in each case moved by a piston-like selecting member out of the heald stack into an intermediate position and is pushed from this intermediate position by a plunger onto needle-like holding means. The latter form a component of the heald distribution module HD.

According to Swiss Patent Application 2699/90, the drop wires LA are pushed up slightly from their stack by a friction roller so that their head end projects freely upwards. In this position, a hook mounted on a conveyor belt grips the drop wires and pulls them completely out of the stack into a transfer station. In the latter, the suspended drop wire is blown by compressed air onto corresponding holding means which form a component of the drop-wire distribution module LD.

Figure 3:
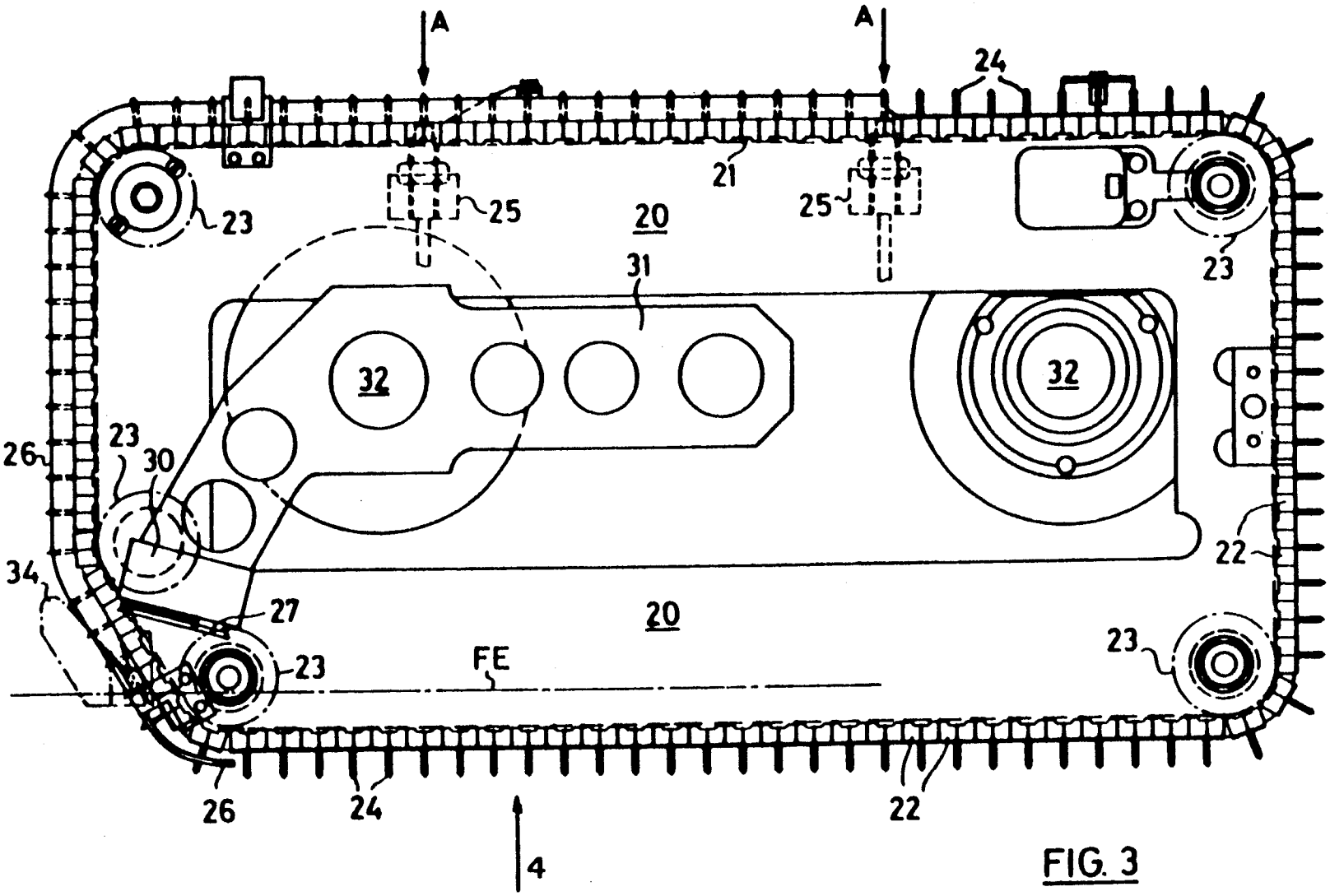
FIG. 3 shows a plan view of a device according to the invention for manipulating healds in the direction of arrow 3 in FIG. 2.
Figure 4:
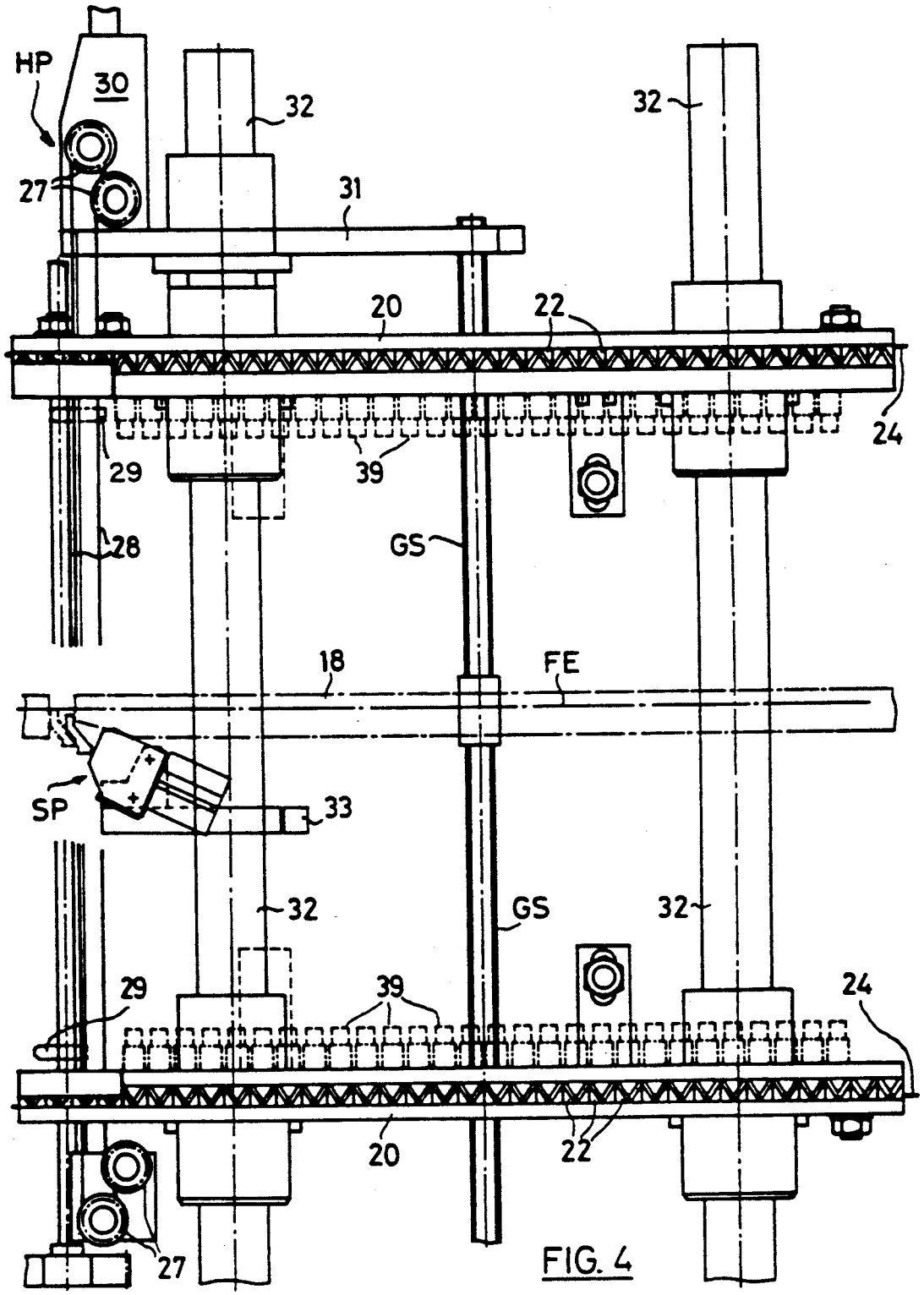
FIG. 4 shows a view in the direction of arrow 4 in FIG. 3.
Figure 5:
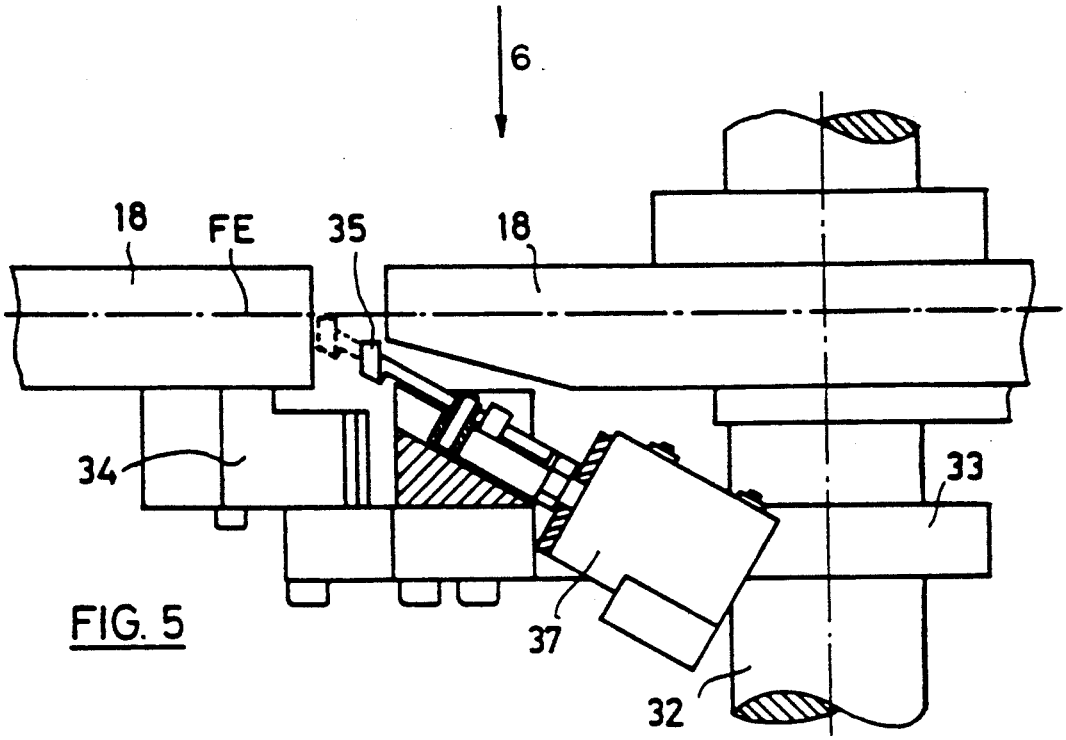
FIG. 5 shows a detail of FIG. 4 to an enlarged scale.
Figure 6:
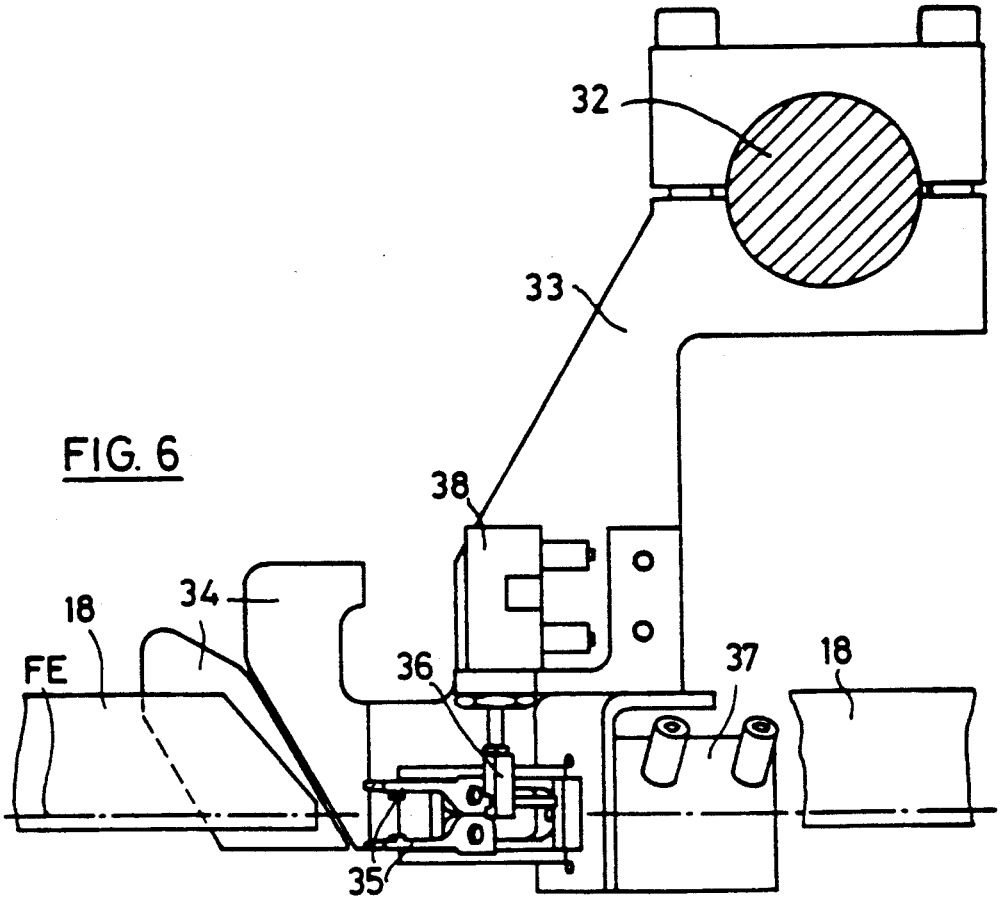
FIG. 6 shows a view in the direction of arrow 6 in FIG. 5, FIG. 7 hows a plan view of a device according to the invention for manipulating drop wires.

The heald distribution module HD is shown in FIGS. 3 to 6. FIG. 3 shows a plan view to a scale of about 1:2.5, FIG. 4 shows a side view in the direction of arrow 4 in FIG. 3 to a slightly smaller scale, and FIGS. 5 and 6 show a detail to an enlarged scale.

According to the representation, the heald distribution module HD essentially comprises two components: transport planes formed by appropriate plates 20, in each of which planes an endless transport means provided with heald holders is guided. This transport means is designed like a band, belt or chain. A chain is preferably used as the transport means, which chain consists of individual links 22 carried by a toothed belt 21. The toothed belt 21 is provided with a tooth system on either side; the tooth system on the inside meshes with corresponding guide rollers 23, of which at least one is motor-driven. The tooth system on the outside of the toothed belt 21 centres the chain links.

On its side remote from the toothed belt 21, each of the chain links 22 has a projecting V-shaped rib, to whose apex a pin 24 designed to serve as a heald holder is anchored. The end hooks of the healds are slipped onto the pins 24. The positions of the upper and lower belts 21 carrying the chain links 22 are adjustable relative to each other so that the mutual vertical distance between the two sets of pins 24 can be adjusted to accommodate therebetween healds of different lengths. This may be accomplished through adjusting means that includes a threaded spindle GS which meshes with thread locks mounted on the plates 20 of the transport planes.

The healds are transferred to the heald distribution module HD at the locations designated by arrows A, the two arrows symbolising the fact that the separation of the healds and their transfer takes place in two channels, although this is not absolutely necessary. Sensors 25 for monitoring the heald acceptance are present at the acceptance locations. After acceptance, the healds are transported to the thread drawing-in position by the chain 21, 22 rotating anti-clockwise and driven intermittently by a stepping motor.

Provided between the acceptance point A and the thread drawing-in position is a guide rail 26 which prevents the healds from falling off the pins 24. In FIGS. 3 to 6, the thread drawing-in path is designated by a chain-dotted straight line FE; the thread drawing-in position of the healds is the point at which their path intersects the straight line FE.

In this area, the channel-like guide 18 (FIG. 2) has an interruption through which the healds cross the guide 18. Since the thread eyelet of the healds is relatively small, the healds must be positioned very accurately for the drawing-in of the thread. This precise positioning is effected vertically on the one hand, that is, in the longitudinal direction of the healds, and laterally on the other hand, that is, transversely to the longitudinal direction and transversely to the thread drawing-in path FE by corresponding positioning means HP and SP respectively. The vertical-positioning means HP apparent from FIG. 4 comprise an endless cable 28 which is guided via drive rollers 27 and to whose two sides one positioning pin 29 each is fastened. Upon actuation of the vertical-positioning means HP, these positioning pins shift up and down and press against the V-shaped ribs of the two chain links 22 carrying the heald to be positioned. The drive for the cable 28, which drive is formed by a pneumatic cylinder 30, and the top drive rollers 27 are mounted on a supporting arm 31. The supporting arm 31 is carried by a support shaft 32 passing through the heald distribution module HD. A total of two support shafts 32 of this type are provided.

The lateral-positioning means SP apparent in particular from. FIGS. 5 and 6 are mounted in the area of the channel-like guide 18 on a supporting means 33 that is likewise fastened to the support shaft 32 carrying the supporting arm 31. The lateral positioning means SP comprise a cross guide 34 for the healds, a positioning lever 35 and a control stirrup 36. The cross guide 34, which is arranged just below the channel-like guide 18, has a funnel-like entry part and, following the entry part, a relatively narrow guide part in which the healds are guided fairly accurately with regard to their lateral displacement. The exact lateral positioning is effected by the positioning lever 35. This positioning lever 35 is designed as a two-piece gripper. It is driven by a pneumatic cylinder 37 and is moved at an angle from below towards the heald to be positioned. In its end position drawn in broken lines in FIG. 5, the positioning lever 35 is closed by the control stirrup 36 driven by a pneumatic cylinder 38, as a result of which the heald is firmly clamped and positioned for the drawing-in of the thread.

Following the drawing-in of the thread, the heald is released again from the positioning lever 35 so that it can leave the cross guide 34 and finally also the guide rail 26 and can be transferred to its heald supporting rail. This transfer is effected by pneumatically driven ejector cylinders 39 which are arranged in the area of the two plates 21. The cylinders 39 can be selectively activated as a function of the distribution, predetermined by the pattern to be produced on the weaving machine, of the healds over the individual heald shafts. In fact in each case the top and bottom ejector cylinder 39 of each heald can be activated in pairs. According to the representation, twenty-eight top and bottom ejector cylinders 39 each are provided, so that the healds can be distributed over a maximum of twenty-eight shafts.

Figure 7:
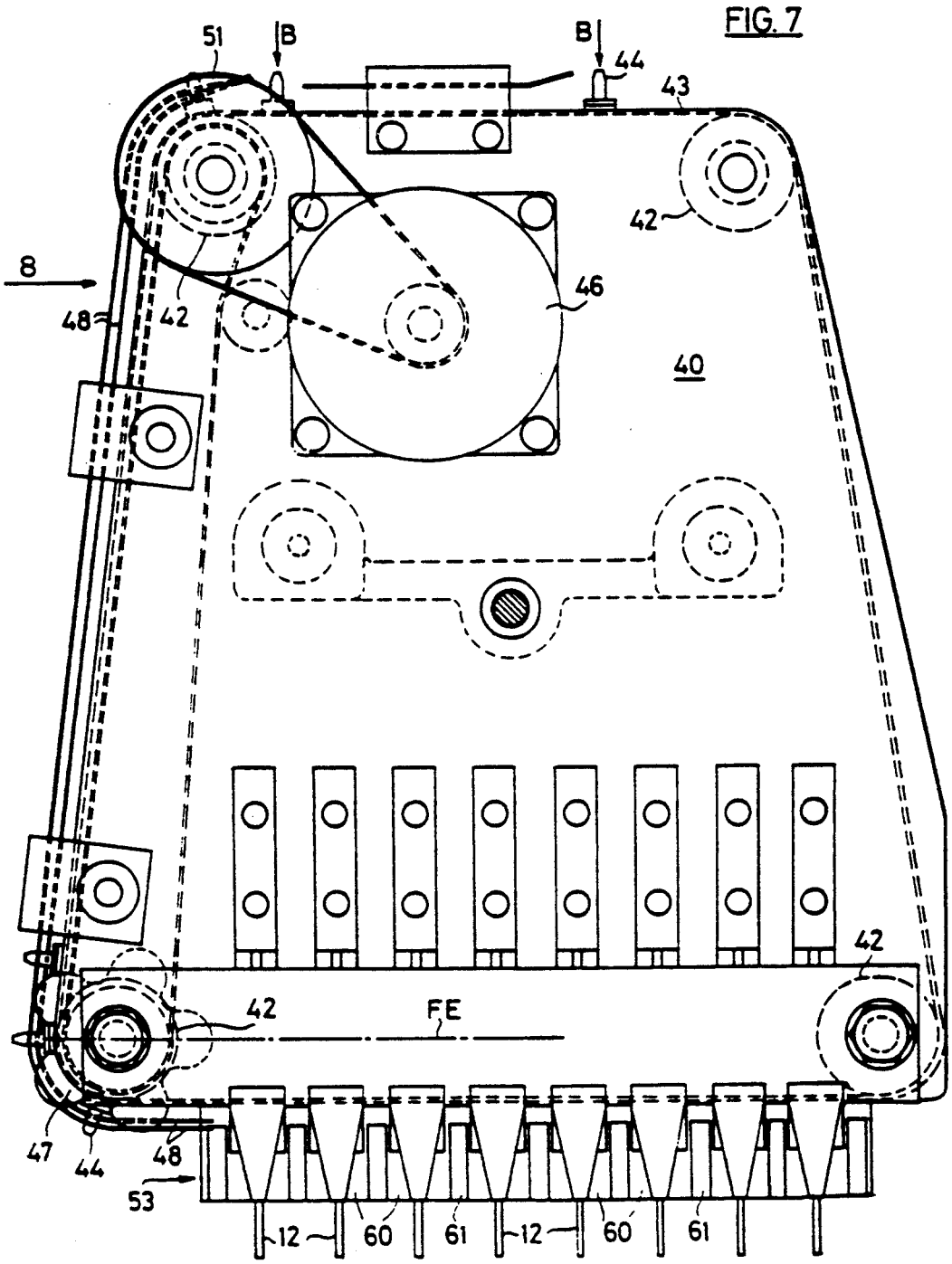
Figure 8:
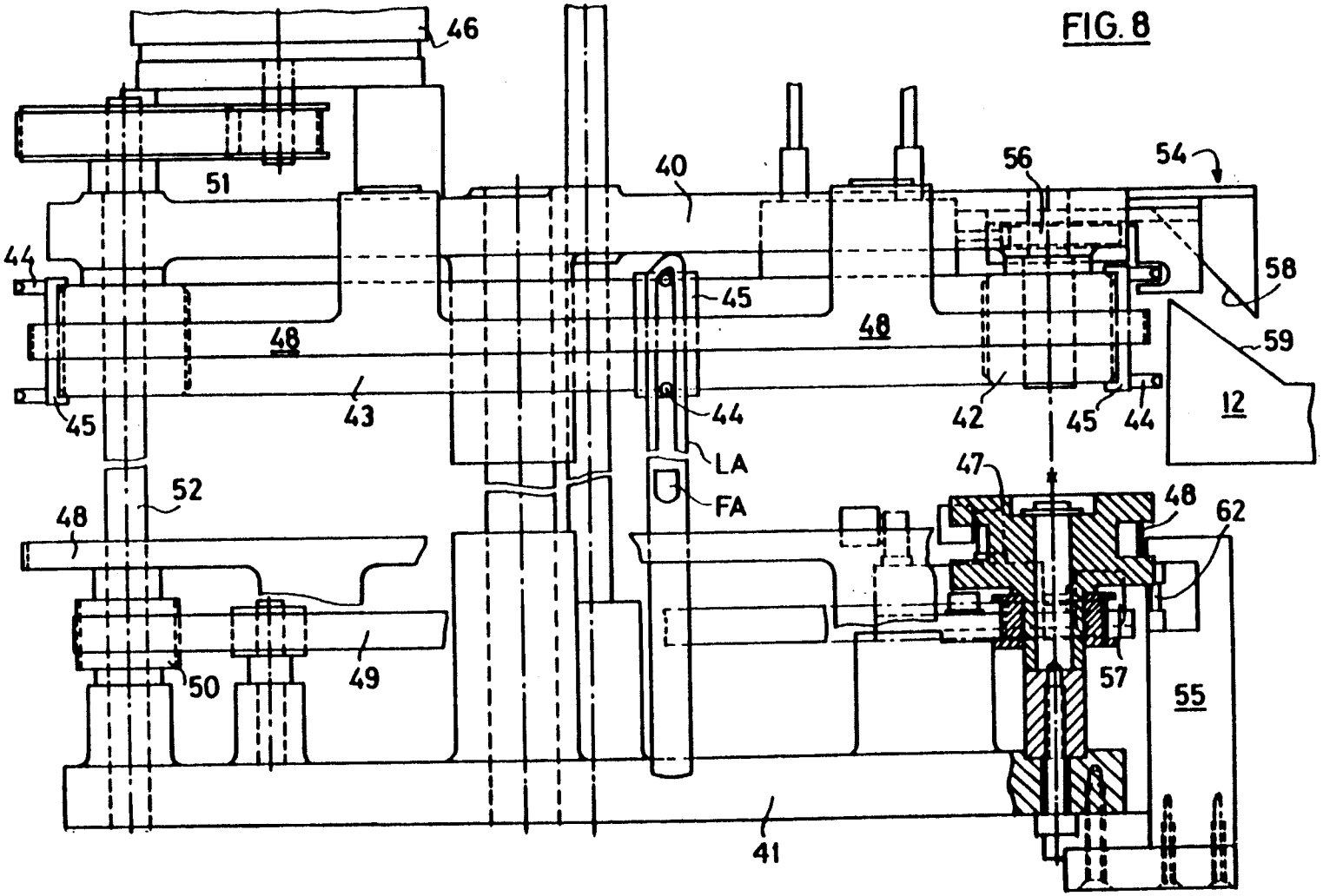
FIG. 8 shows a view in the direction of arrow 8 in FIG. 7.

The drop-wire distribution module LD is shown in FIGS. 7 and 8, and in fact in FIG. 7 is shown in a plan view to a scale of about 1:1.5 and in FIG. 8 is shown in a side view in the direction of arrow 8 in FIG. 7. The function of the drop-wire distribution module LD is very similar to that of the heald distribution module HD. The main differences between the two lie in the fact that the drop wires are shorter than the healds, that their thread eyelet is substantially larger than that of the healds so that the demands made on the positioning accuracy for the drawing-in are no so great, and that the number of drop-wire supporting rails is substantially smaller than that of the heald supporting rails.

Just like the heald distribution module HD, the drop-wire distribution module LD contains as a basis two plates 40 and 41 which are spaced apart at and serve as supporting means for the various transport and positioning means for the drop wires LA. The distance between the two plates 40, 41 can be adjusted. Stretched on the top plate 40 via corresponding gearwheels 42 is an endless toothed belt 43, to the outside or which holding means for the drop wires LA are fastened. These holding means consist of a small plate 45 having two supporting pins 44 arranged vertically one below the other. The drop wires LA are suspended with their supporting slit on the supporting pins 44.

The drop wires are transferred to the holding means 44, 45 at locations designated by arrows B, the two arrows symbolising two processing channels of the drop-wire separation stage. The acceptance of the drop wires by the drop-wire distribution module LD is monitored by sensors (not shown). After acceptance, the drop wires LA are transported by the toothed belt 43, which moves in an anti-clockwise and is driven intermittently by a stepping motor 46. The drop wires LA are transported to the thread drawing-in position, which lies in the area of a star-shaped positioning wheel 47 carried by the bottom plate 41. To prevent the drop wires from falling off the supporting pins 44, a guide rail 48 is provided in the area of the two plates 40, 41. Each guide rail 48 extends between the acceptance location B and a point directly after the thread drawing-in position.

The channel-like guide 18 (FIG. 2) passes through the drop-wire distribution module LD along the chain-dotted straight line FE (FIG. 7), which marks the thread drawing-in path, at a level between the two plates 40 and 41. The thread drawing-in position is located at the point at which this straight line FE passes through the toothed belt 43 at the positioning wheel 47, which point is designated by an x in FIG. 8. The thread eyelet FA of the drop wire LA positioned by the supporting pins 44 and between the projections of the positioning wheel 47 is then in alignment with the straight line FE. In this area, the channel-like guide 18 (FIG. 2) has an interruption in which the drop wires LA cross the guide 18.

The positioning wheel 47 is likewise driven intermittently, and in fact via a toothed belt 49 and a gearwheel 50. The gear wheel 50 is fastened to the drive spindle 52 of the toothed belt 43 which carries the holding means 44, 45 for the drop wires LA. The drive spindle 52 is driven by the stepping motor 46 via a toothed-belt drive 51.

After the drawing-in of the thread in the area of the positioning wheel 47, the drop wires LA, now carrying one drawn-in warp thread each, pass into the area of a bank-like row 53 of transfer stations. As shown in FIG. 7, a total of eight transfer stations provided in accordance with the number of (eight) possible drop-wire supporting rails 12 (FIG. 1) In the transfer stations, the drop wires LA are pushed according to a program onto the corresponding drop-wire supporting rails 12.

According to the representation, the transfer stations consist of a top and a bottom substation 54 and 55, each of which is fastened to the corresponding plate 40 or 41. Both substations 54 and 55 each have a pneumatically driven ejector 56 and 57 respectively, upon actuation of which the relevant drop wire LA is pushed onto its supporting rail 12. The top substation 54 is designed in such a way that when the drop wires are being pushed down from the supporting pins 44, the drop wires LA run with their topmost edge against a guide plane 58 that slopes downwards. Thus, the drop wires LA directed downwards so that they are positively guided onto an entry flank 59 (of corresponding sloping design) of the drop-wire supporting rails 12 and slide along from this entry flank 59 onto the horizontal part of the drop-wire supporting rail 12.

The bottom substation 55 contains a shaft-like chamber 60 which is open to the front, rear and top and is separated from the chamber of the adjacent stations by cross walls 61. Each chamber 60 is closed off from the toothed belt 43 and the ejector 57 by a flap 62 like a double swing door. This flap 62 serves as a safety device to prevent the drop wires LA from falling off the supporting pins 44 unintentionally as a result of the tension force of the drawn-in warp threads. When activated, the ejector 57 pushes open the flap 62 and as a result pushes the drop wire LA at its bottom part into the chamber 60; at the same time, the top ejector 56 pushes the drop wire from its supporting pins 44 towards the guide plane 58 and onto the entry flank 59 of the drop-wire supporting rails 12. The latter are held in the transfer position by distance plates displaceable in the longitudinal direction of the rails; when they are displaced along the drop-wire supporting rails 12, the distance plates transport the drop wires further. The drop-wire supporting rails 12 are held in the horizontal position by retractable and extendable holding bolts fastened to a transport system. In their retracted position, these holding bolts position the drop-wire supporting rails 12; they are extended for passing the drop wires at the relevant location.

At their top plate 21 or 40, both the heald and the drop-wire distribution module HD and LD respectively are provided with corresponding covering hoods which on the one hand cover the entire mechanism and protect the same from being covered in dust and on the other hand have connections for the requisite pneumatic and electronic lines.

What is claimed is:

1. Device for manipulating harness members in a warp-thread drawing-in machine from a place at which the harness members are separated from a stack to a place where the harness members are transferred to supporting members for being arranged in a weaving machine, comprising holding means for receiving separated harness members and for transporting them to a drawing-in station at which warp threads are drawn-in with respect to the harness members and a transfer station at which the harness members are transferred to the supporting members, positioning means arranged adjacent the drawing-in station for positioning the harness members to have a warp thread drawn-in, and transfer means arranged adjacent the transfer station for transferring the harness members having a drawn-in warp thread to the supporting members, said holding means including a movably driven endless member and spaced apart holding members mounted on the endless member for receiving a plurality of harness members, said endless member transporting the plurality of harness members received on the holding members to the drawing-in station and to the transfer station.

2. Device according to claim 1, wherein said endless member includes an intermittently driven endless belt from which said holding members extend at regular intervals.

3. Device according to claim 2, including drive and guide rollers around which the endless belt passes.

4. Device according to claim 3, wherein said holding members are pins and said endless belt is a chain comprised of a plurality of links.

5. Device according to claim 4, including guide means for preventing the harness members from falling off the holding members, said guide means extending between a place on said belt at which harness members are received on the holding members and the transfer means.

6. Device according to claim 5, wherein said holding means includes two spaced apart endless belts which each have holding members extending therefrom, the distance between the endless belts being adjustable for allowing harness members of different lengths to be received on the holding members.

7. Device according to claim 6, wherein said positioning means includes means for vertically positioning the harness members in a longitudinal direction of the harness members and means for laterally positioning the harness members in a direction transverse to the longitudinal direction of the harness members.

8. Device according to claim 7, wherein the means for vertically positioning the harness members includes positioning pins mounted on a movable cable.

9. Device according to claim 8, including drive means on which the cable is mounted for moving the cable and vertically adjusting the position of the positioning pins, said links having a rib-like projection for engaging the positioning pins.

10. Device according to claim 7, wherein the means for laterally positioning the harness members includes a positioning lever that is displaceable transversely to the longitudinal direction of the harness members and a control stirrup for actuating the positioning lever.

11. Device according to claim 10, wherein the positioning lever is a two-piece gripper and is actuated by the control stirrup in such a way that the harness member to be positioned is held in a drawing-in position by the positioning lever.

12. Device according to claim 5, wherein the holding members include two vertically spaced apart supporting pins for engaging a supporting slit in the harness members.

13. Device according to claim 12, wherein the two supporting pins are mounted on a support plate said supporting plate being fastened to said endless belt.

14. Device according to claim 13, wherein a head part of the harness members is held on the holding members, said holding members being mounted on a support plate so that the harness members can hang down freely from the holding members.

15. Device according to claim 14, wherein the positioning means arranged adjacent the drawing-in station include means acting on a part of the harness members which hangs down freely for laterally fixing the position of the harness members.

16. Device according to claim 15, wherein said means for acting on a part of the harness members which hangs down freely includes a star-shaped positioning wheel provided with lobe-shaped projections so that the harness members are fixed between the guide means and the projections of the positioning wheel.

17. Device according to claim 16, including drive means for driving the positioning wheel and the endless belt.

18. Device according to claim 17, wherein said transfer means includes two pneumatically driven slides which push against the harness members at spaced apart locations along the harness members.

19. Device according to claim 18, wherein the transfer station for the harness members includes a top substation and a bottom substation, said two slides including a top slide located at the top substation and a bottom slide located at the bottom substation.

20. Device according to claim 19, wherein the top substation has a sloping guide edge which guides a front edge of the harness members towards a supporting member when the harness members are pushed down from the holding members by the slides.

21. Device according to claim 20, wherein the guide edge slops down away from the holding members so that the harness members can be transferred to supporting members which slope in a corresponding manner.

22. Device according to claim 19, wherein the bottom substation includes a chamber for receiving the harness members and a closure for closing the chamber to inhibit harness members received on the holding members from unintentionally falling off the holding members.

23. Device according to claim 22, wherein the closure is positioned adjacent the bottom slide so that during a working stroke of the bottom slide the closure is opened and the harness member is pushed into the chamber.

* * * * *